US008733007B2

(12) United States Patent
Hatfield

(10) Patent No.: US 8,733,007 B2
(45) Date of Patent: May 27, 2014

(54) MAGAZINE ASSEMBLY FOR A FIREARM

(71) Applicant: Ted Hatfield, Fairway, KS (US)

(72) Inventor: Ted Hatfield, Fairway, KS (US)

( * ) Notice: Subject to any disclaimer, the term of this patent is extended or adjusted under 35 U.S.C. 154(b) by 0 days.

(21) Appl. No.: 13/686,399

(22) Filed: Nov. 27, 2012

(65) Prior Publication Data

US 2013/0081314 A1 Apr. 4, 2013

Related U.S. Application Data

(63) Continuation-in-part of application No. PCT/US2011/038388, filed on May 27, 2011.

(51) Int. Cl.
*F41A 9/62* (2006.01)

(52) U.S. Cl.
USPC ..... 42/1.02; 42/17; 42/49.01; 89/33.04

(58) Field of Classification Search
USPC ..... 42/1.02, 11, 17, 21, 24, 29, 33, 35, 37, 42/6, 49.01; 89/33.01, 33.1, 33.04
See application file for complete search history.

(56) References Cited

U.S. PATENT DOCUMENTS

| | | | | |
|---|---|---|---|---|
| 3,665,631 | A | 5/1972 | Domian et al. | |
| 4,821,442 | A * | 4/1989 | Bock | 42/17 |
| 4,864,759 | A | 9/1989 | Ferri | |
| 4,905,395 | A | 3/1990 | Wagner | |
| 5,119,575 | A | 6/1992 | Gajdica | |
| 5,206,444 | A | 4/1993 | Oliver | |
| 5,367,810 | A | 11/1994 | Stead et al. | |
| 7,806,036 | B2 | 10/2010 | Cook et al. | |
| 2004/0020093 | A1 * | 2/2004 | Hajjar et al. | 42/49.01 |
| 2010/0154268 | A1 * | 6/2010 | Mautone Medvedeo | 42/19 |
| 2010/0293830 | A1 | 11/2010 | Winge | |
| 2014/0000143 | A1 * | 1/2014 | Safewright, Jr. | 42/49.02 |

OTHER PUBLICATIONS

International Search Report and Written Opinion, PCT Patent Application No. PCT/US2011/038388, Dec. 14, 2011.

* cited by examiner

*Primary Examiner* — Gabriel Klein
(74) *Attorney, Agent, or Firm* — James R. Eley; Michael A. Forhan; Eley Law Firm Co., LPA

(57) ABSTRACT

A magazine assembly (10) for receiving and storing cartridges (28) for a firearm (1). At least one gate member (58, 60) is pivotally mounted at an open end of a monoblock (20) and has a first blocking member (58.1, 60.1) to inhibit feeding of an end cartridge from a feed port until the firearm (1) is cocked. The gate member (58, 60) further includes a second blocking member (58.4, 60.4) to prevent multiple cartridges (28) from feeding from the same feed port (20.3, 20.4) during a given cocking cycle. The gate member (58, 60) is operable to displace the first blocking member (58.1, 60.1) out of a cartridge feed path while placing a second blocking member (58.4, 60.4) in the feed path to of the next cartridge (28) to be fed. An interrupter (62) prevents cartridges (28) supplied by a plurality of feed ports (20.3, 20.4) from being fed simultaneously.

17 Claims, 7 Drawing Sheets

MAGAZINE ASSEMBLY FOR A FIREARM

CROSS-REFERENCE TO RELATED APPLICATIONS

This application is a Continuation-in-Part application and claims priority to PCT Patent Application Ser. No. PCT/US2011/038388, filed May 27, 2011, the contents of which is incorporated herein in its entirety by reference thereto.

FIELD OF THE INVENTION

This invention relates to a magazine assembly for use with a firearm particularly, but not necessarily exclusively, a pump action shotgun.

BACKGROUND

In some shotguns in use today, especially of the semi-automatic and pump action type, multiple shotgun cartridges are loaded into a single, stationary magazine tube, generally positioned below and parallel to the shotgun barrel. Charging the weapon is usually accomplished by inserting a first live cartridge into the weapon's chamber through the ejection port and then chambering the cartridge by releasing the bolt. With the shotgun safety engaged, additional cartridges may be loaded into the magazine through the downwardly-biased loading tray located on the bottom of the weapon directly below the chamber. While loading a tube-type magazine, one must first overcome the downward pressure exerted by the loading tray and then push the cartridge forward in the tube against the bias of a magazine tube spring. The magazine tube spring asserts continuous pressure on the loaded cartridges, urging them toward the rear of the gun to be chambered into the barrel by a bolt after the weapon ejects a previously fired cartridge.

In a typical sporting shotgun having a tube magazine, the total capacity of the tube magazine may be up to 8 (but sometimes more), depending upon the design and length of the barrel. In a special sporting or tactical shotgun for use in no round limitation hunting or by military and law enforcement units, shorter shotguns may be preferable to accommodate tighter operating environments, in other words, during close combat situations. Unfortunately, a shorter tactical shotgun necessarily has a shorter tubular magazine length and thus is typically limited to 6 or 7 cartridges or even less, thereby reducing the reserve firepower available to the operator of the weapon. This is not desirable because in the time it takes to reload a limited capacity weapon, the user may be vulnerable to the opposing target of interest or otherwise lose the opportunity to engage the target.

Attempts in the firearms industry have been made to overcome some of the drawbacks to a lower capacity shotgun. One approach has been to increase a weapon's capacity by adding a box magazine extending from beneath the gun, for example, as shown in U.S. Pat. No. 4,864,759, issued to Crossman. While this appears to provide additional capacity proportional to the length of the magazine, it introduces the tactical disadvantage of the weapon becoming more cumbersome to handle in tight quarters. Thus, the increased capacity may be outweighed by the difficulty in being able to maneuver freely while wielding the weapon.

Others have attempted to overcome the lower capacity issue by fitting a shotgun with either a rotary drum magazine, such as shown in U.S. Pat. No. 7,806,036, issued to Cook et al., U.S. Patent Publication No. 2010/0293830, submitted by Winge, or multiple tube magazines operated in a rotary fashion in line with the barrel of a shotgun, as shown, for example, in U.S. Pat. Nos. 4,905,395, issued to Wagner and 5,119,575, issued to Gajdica. While appearing to increase the capacity of a tactical shotgun, it is not without introducing the increased cost and complexity associated with a rotating feed mechanism, as well as an increased risk of a malfunction stemming from the introduction of rotating parts into an otherwise generally linear cartridge feeding system.

Yet another approach to increasing the capacity of a shotgun is shown in U.S. Pat. No. 5,367,810, issued to Stead, et al., which depicts dual magazines, located side by side and pivotable upwardly, much like the barrels of a double-barreled shotgun, between operative (feeding) and inoperative (loading) positions. While this approach successfully increased the capacity of a shorter tactical shotgun from 7 or 8, to as many as 15 standard sized shotgun cartridges, the need to open the breach of the shotgun in order to load the two magazine tubes from the rear makes for a somewhat cumbersome process.

What is needed is a higher capacity magazine arrangement for use in a special purpose hunting and/or tactical shotgun that is easy to load, can be quickly loaded, simultaneously accommodates a variety of cartridge lengths and types, and loads without requiring the opening of the breach of the shotgun.

SUMMARY

According to the embodiment of the magazine assembly disclosed herein, many of the shortcomings in the prior art have been overcome. According to the disclosed embodiments, there is provided a stationary magazine assembly for a firearm which includes at least one tubular member for receiving a plurality of cartridges, the tubular member being non-displaceably coupled, i.e. fixed, to a "monoblock" portion of the firearm to permit receiving fresh cartridges and without articulation of the tubular member. As used herein, the term "cartridge" is used to refer to a variety of loaded firearm projectiles, also referred to as "rounds" or "shells".

During the cartridge loading process, access to each tubular magazine member is provided at the rear and side of the respective side of the monoblock member through hinged port covers. A coil spring is provided within the tubular members to provide rearward pressure, once loaded, on the cartridges within the tube member. During the loading process, the magazine spring may be compressed by a magazine follower member that is slidably moveable between inoperative, loading position and an operative, feeding position. To aid in the loading process, the magazine assembly may be provided with a means for securing the magazine spring in a compressed condition. In this manner, there is no need to exert manual pressure against the spring while loading cartridges into the tubular members. In another embodiment tubular magazine members may be provided as continuous tubes with no externally operable magazine follower to compress the magazine spring, thus sealing the magazine and internal magazine spring from environmental conditions such as dirt, sand and inclement weather.

Gate members are provided for each tubular magazine member and pivotally mounted in an area at the rear (towards the operator) of the magazine assembly at the open end of the monoblock, each of which have a first blocking portion locatable in the feed path of the end-most cartridges. This arrangement inhibits the unintended ejection of the cartridge from the tubular member. The gate member co-operates with a cocking mechanism portion of the shotgun when the fore-arm is actuated ("racked") to the rear of the firearm which temporarily displaces the first blocking portion out of such feed path, thus allowing the end-most cartridge to be fed and chambered into the firearm barrel by a bolt member upon the return cycling of the cocking assembly. The gate member may also be configured to have a second blocking portion located on the opposing side of a pivot of the gate member. This second blocking portion is configured to project through a slot into the monoblock member behind the end-most cartridge thus inhibiting travel of the next cartridge within a portion of the monoblock as the end-most cartridge is fed from the opposing feed port of the magazine assembly.

The magazine assembly may have a plurality of tubular members arranged in a side by side relationship. In such an arrangement, the magazine assembly may also include at least one passive, toggling interrupter ("reciprocating" or "wig-wag") at an end region of the monoblock for inhibiting the feeding of the end-most cartridge from the feed port of one tubular member while another cartridge is being fed and chambered from the adjacent monoblock feed port.

The interrupter may be pivotally mounted in the monoblock and may be in the form of a plate having ramped shoulder portions on opposing sides of its rearmost end. The plate is pivotable for projecting into the feed path of the opposing side of the dual tube monoblock in response to the staging of the end-most cartridge in the feed port of the other side of the monoblock into a "ready to feed" condition. The interrupter may be urged alternately into an opposing side of the monoblock as the end-most cartridge moves to its fully staged position in the adjacent tubular member. The monoblock may be arranged at the open ends of the tubular members and configured to secure the tubular members in a fixed condition with respect to the firearm. The monoblock may be divided into dual, side-by-side tubular paths and acts as an extension of each of the tubular magazine members in so far as storage and feeding of cartridges are concerned.

The magazine assembly may include a switchable selector member for controllably selecting a particular feed port of the monoblock from which the cartridges are to be fed and chambered. When two tubular members are coupled to monoblock, the selector member may be selectively operated to control the feeding exclusively from either one or the other tubular member or in passive, neutral a mode that automatically alternates the feeding of cartridges between the two feed ports in the monoblock.

The magazine tubes of the magazine assembly may each include a biasing means for urging loaded cartridges towards the respective feed ports at the rear region of the monoblock. The biasing means may be in the form of a magazine follower, slidably housed within the tubular member and urged by a magazine coil spring towards the open end of the monoblock. The follower may have a leading end which is narrower than its trailing end so as not to foul the interrupter in the absence of cartridges within a particular tubular member, i.e., when the tubular member is "dry."

In the alternative, the magazine tubes within the magazine assembly may include a biasing means for urging loaded cartridges towards the feed ports at the rear region of the monoblock but without using externally operable magazine followers. The follower may have a leading end which is narrower than its trailing end so as not to foul the interrupter in the absence of cartridges within a particular tubular member, i.e., when the tubular member is "dry." Also, the magazine tubes may be provided as continuous, unslotted cylinders, either clear or opaque. In this regard, the internal areas of the magazine tubes are sealed against debris entering the slotted portions and, if provided as clear, the number of remaining shells may be visibly monitored by the operator of the weapon.

The invention extends also to a firearm having a magazine assembly as above described and which includes a bolt carriage having parallel feed rails located within a receiver for the firearm for guiding a cartridge fed from the magazine assembly immediately prior to being chambered into the barrel of the firearm. The feed member mounted rearward of the magazine assembly is downwardly biased and actuable between inoperative and operative positions for urging cartridges fed from the magazine assembly squarely onto the parallel rails of the bolt carriage located within the receiver of the firearm. The feed member may be held in its inoperative position by a pivotable tripper mechanism which is mounted in the path of and triggered by a cartridge being fed from either feed port of the magazine assembly under the substantial pressure of the magazine and follower springs. The feed member is re-biased into its upward, inoperative position as the cartridge is chambered into the barrel by the bolt assembly by racking the forearm of the firearm to its forward position.

BRIEF DESCRIPTION OF THE DRAWINGS

Various embodiments of the invention are now described by way of example, and not by limitation, with reference to the accompanying drawings.

In the drawings.

DETAILED DESCRIPTION

Figure 1:
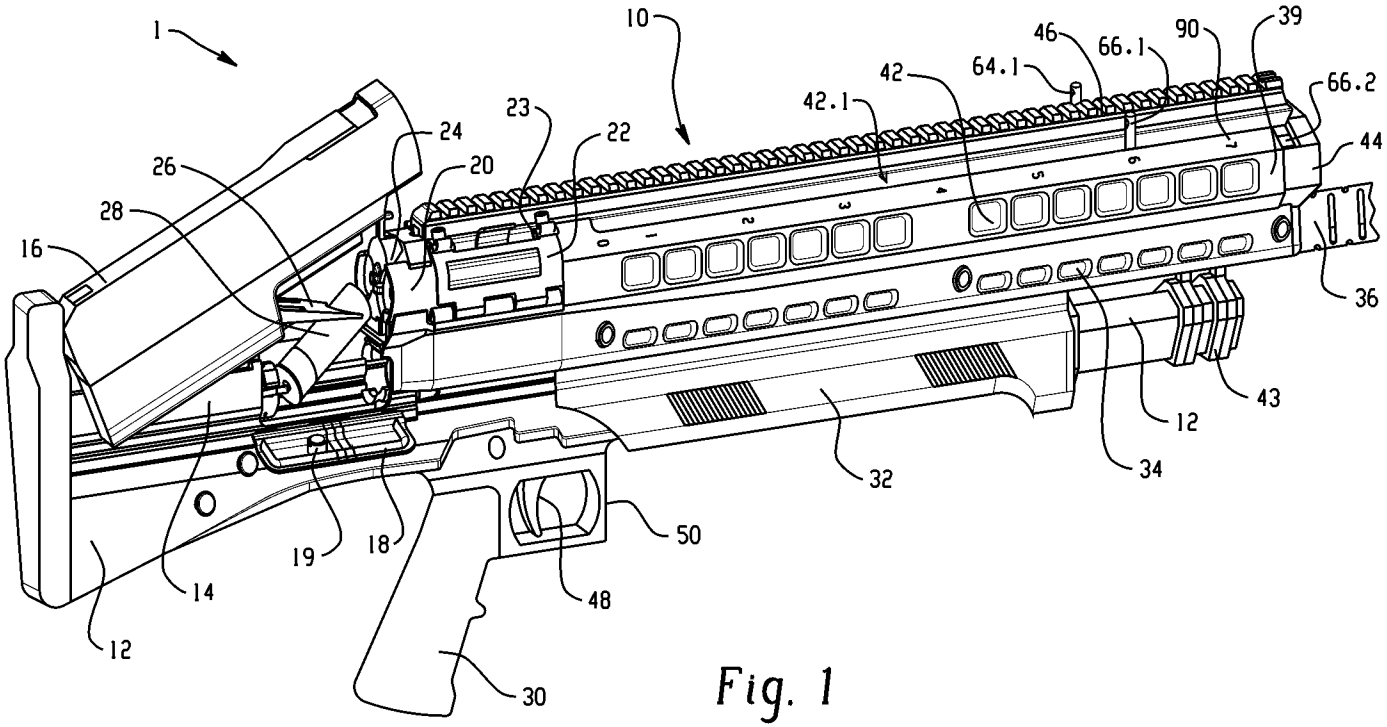
FIG. 1 is an elevational perspective view of a firearm outfitted with a dual tube magazine assembly according to an embodiment of the present disclosure.

Referring to FIGS. 1 to 8, reference numeral 1 generally refers to pump action shotgun and reference numeral 10 generally indicates a non-displaceable magazine assembly for use with the pump action shotgun, although other firearm configurations may effectively utilize the disclosed invention.

In all the embodiments disclosed herein, the magazine assembly 10 utilizes a pair of tubular members 40, 42 arranged in side by side, parallel relationship for containing a plurality of cartridges 28 stacked along their respective longitudinal axes. A monoblock 20 is arranged intermediate the tubular members 40, 42, and their respective open ends 40.3, 42.3 and provides for captively retaining the tubular members by the engagement of locking members 40.3, 42.3 with bayonet-type mounting slots 20.1, 20.2, respectively. An interrupter 62 and gate members 58 and 60 are each operatively mounted to the monoblock 20 and interact with corresponding slots provided therein, the significance of which will become apparent hereinafter. This can be seen in FIGS. 5 and 6 when viewed together.

The sides of monoblock 20 have left and right loading ports 20.6, 20.7 whereby cartridges 28 may be loaded into the corresponding tubular magazine member 40, 42. It will be noted that the tubular members 40, 42 need not be loaded with the same type or number of cartridges 28, as the magazine assembly 10 will still operate to feed cartridges from the complementary tubular feed port when one is empty. The tubular members 40, 42 may also be loaded with different types of cartridges 28 and the selector member 24 used to select the type of cartridge to be fed into the feed area 27 to be loaded into the chamber of barrel 78. For the purposes of this disclosure, the term "feed area" refers to the space between the feed ports 20.3, 20.4 and barrel chamber 78. This makes the magazine assembly 10 particularly suited for use under battle and tactical conditions. Additionally, monoblock 20 has left and right cartridge feed ports 20.3, 20.4, from which loaded cartridges 28 are directed into the feed area of pump shotgun 1. The use of the monoblock 20 in connection with shotgun 1 greatly simplifies the design of the weapon, cuts down on to assembly time, and lowers the cost of materials. Monoblock 20 may be fabricated in any one of a variety of ways including, without limitation, molding, machining, and casting and may consist of any one of a number of suitable materials, including, without limitation, carbon reinforced composites, aluminum, steel, tungsten, brass and durable polymers. In the case of the use of non-metallic materials, it may be preferable to subject the polymers to a metalizing coating process to add to the durability of the monoblock 20.

Referring to FIG. 1, pump action shotgun 1 is shown in a tactical or combat configuration. As such, it is shorter than a general purpose sporting shotgun, typically used for hunting game or shooting clay targets. Magazine assembly 10 is mounted in a fixed relationship with shotgun 1 via conventional means that are not detailed in this description and sets generally atop lower receiver 12. Also mounted atop lower receiver 12 is upper receiver 14 which, in turn is covered by collapsing stock 16. Stock 16 is shown in its open condition for purposes of illustration and operation of the cartridge 28 feeding operating during a cocking cycle. Attached to the rear of lower receiver 12 and covering the ejection port of upper receiver 14 is ejection port cover 18 which may be held in the closed position with ejection port magnet 19. Pistol grip 30 attaches to trigger guard 50 which encloses trigger 48, all of which are matingly coupled to lower receiver 12. Lower receiver 12 also provides the sliding platform for fore-end 32 which is utilized during the cocking operation.

Now describing magazine assembly 10, it is seen mounted above barrel 34 and coupled to the lower portion of the shotgun 1 via left (see FIG. 4) and right side covers 38 and 39. Mounted behind side covers 38 and 39 are left (see FIG. 3) and right tubular members 40 and 42 which are each capped at one end by front magazine cap 44. Side covers 38, 39 may include indicia 90 to visually indicate the number of cartridges 28 remaining in each of the tubular members. In the alternative, indicia, as at 90, may appear on portions of top rail 46 to provide the same remaining capacity information. The top edge of side covers 38, 39 are recessed to a degree corresponding to the slots 40.1 and 42.1 in tubular members 40 and 42. This arrangement accommodates the sliding engagement of handles 64.1 and 66.1 extending upwardly from magazine followers 64 and 66. In the alternative, tubular members may be provided as continuous tubing without slots 40.1 and 40.2 and may be fabricated in any one of a variety of ways including, without limitation, molding, machining, and casting and may consist of any one of a number of suitable materials, including, without limitation, carbon reinforced composites, aluminum, steel, tungsten, brass and durable polymers. In the case of polymers, magazine tubes 40, 42 may be fabricated from a clear plastic, thereby enabling an operator of the weapon 1 to visually monitor the number of rounds 28 remaining in each transparent magazine tube. Such magazine tubes 40, 42, may be totally or only partially transparent.

Figure 2:
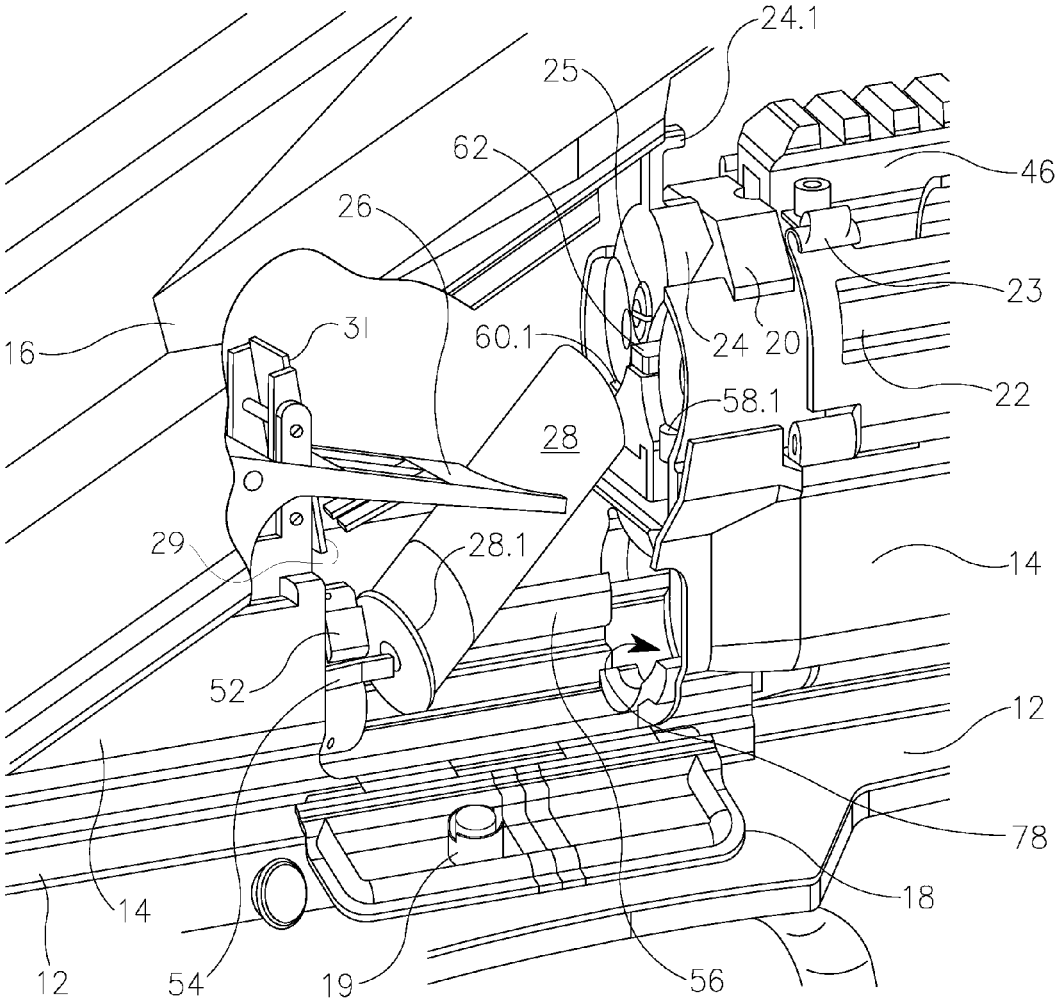
FIG. 2 is an exploded schematic view of the chamber area of the firearm depicted in FIG. 1 depicting a round being fed into the chamber with the assistance of a biased feed member according to an embodiment of the present disclosure.

Referring additionally to FIG. 2, some of the components involved in the cartridge 28 feeding process are detailed therein. Note that selector switch 24 is pivotally mounted to monoblock 20 via selector switch screw 25. In the condition depicted in FIG. 2, that is, in its center position (in a vertical orientation), neither feed path of tubular members 40, 42 is blocked, thereby allowing the interrupter 62 to alternate between the two tubular members thereby utilizing both as an alternating source of cartridges 28. When the partially-rotatable selector switch 24 is urged to either the left or right, that selected feed path would be blocked, thus inhibiting that selected tubular member 40, 42 from feeding cartridges 28 into the feed area 27 of the shotgun 1. This may be desirable in the event that the magazine assembly 10 stores differing cartridge 28 styles in either of the two tubular members 40, 42. For example, left tubular member 40 may be loaded with slug type cartridges, while the left tubular member is loaded with small shot or less than lethal rounds. Also, since the pump action shotgun 1, designated as the Model UTS-15 manufactured by UTAS Makine of Antalya, Turkey, is capable of feeding a wide range of shells lengths without modification to the shotgun, the tubular members 40, 42 may each be loaded with differing lengths of rounds for tactical purposes. Modifications to the feeding system may be made to accommodate shorter rounds, even as short as 1.5".

Figure 3:
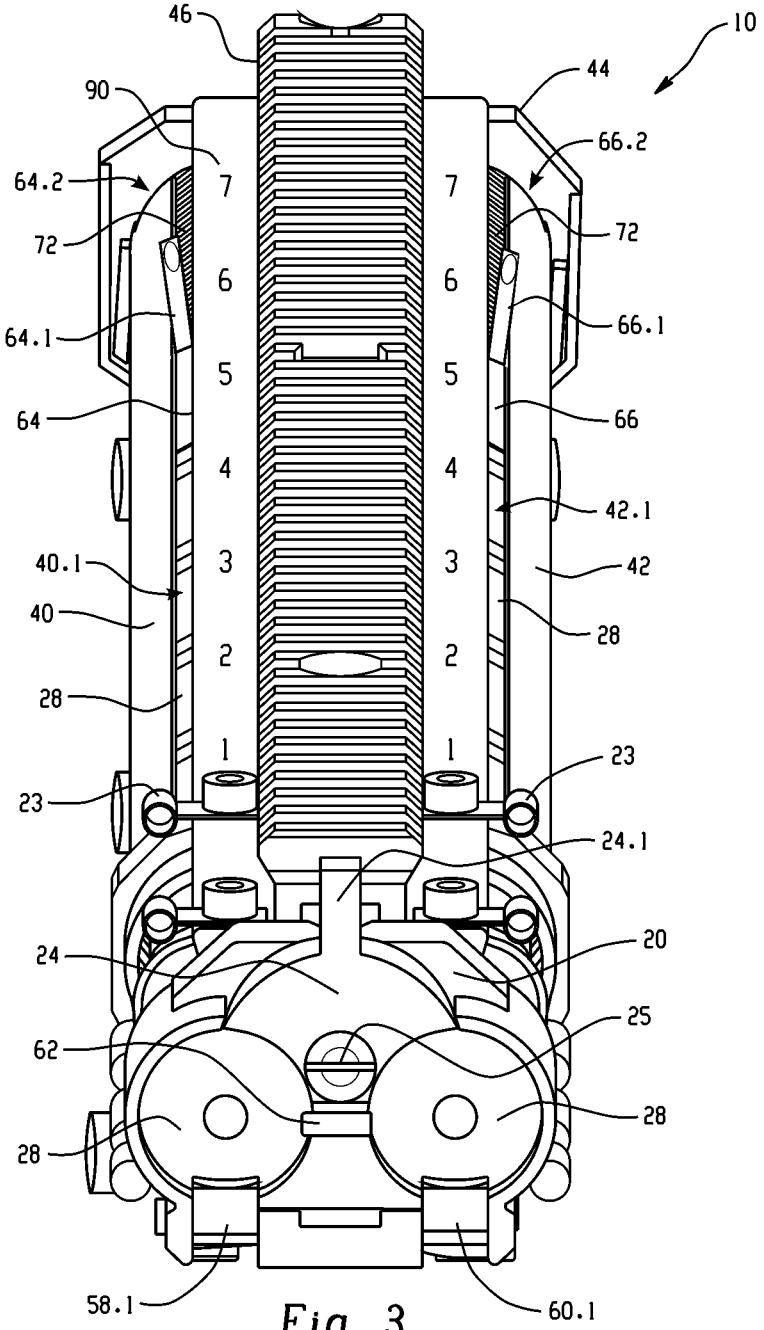
FIG. 3 is a top perspective view of an uncovered magazine assembly for a firearm according to an embodiment of the present disclosure.
Figure 4:
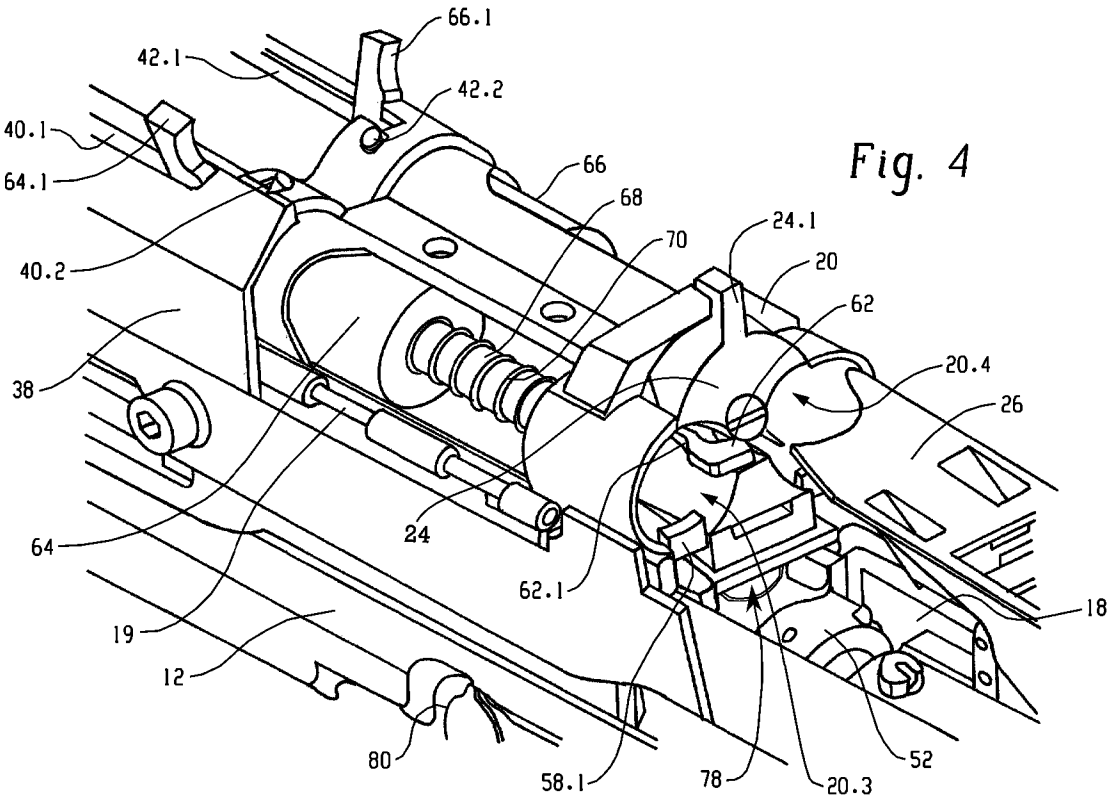
FIG. 4 is a rear perspective view of the chamber area of a firearm, without a rail section or stock, having a magazine assembly according to an embodiment of the present disclosure.
Figure 6:
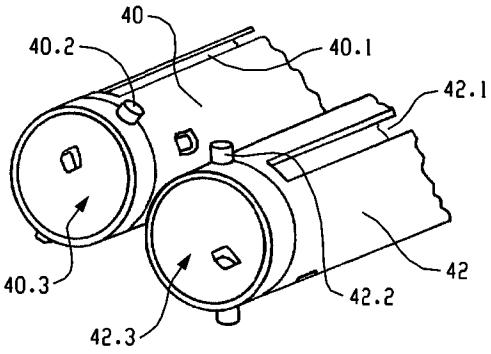
FIG. 6 is a partial schematic view of side by side tubular magazine members according to an embodiment of the present disclosure.
Figure 5:
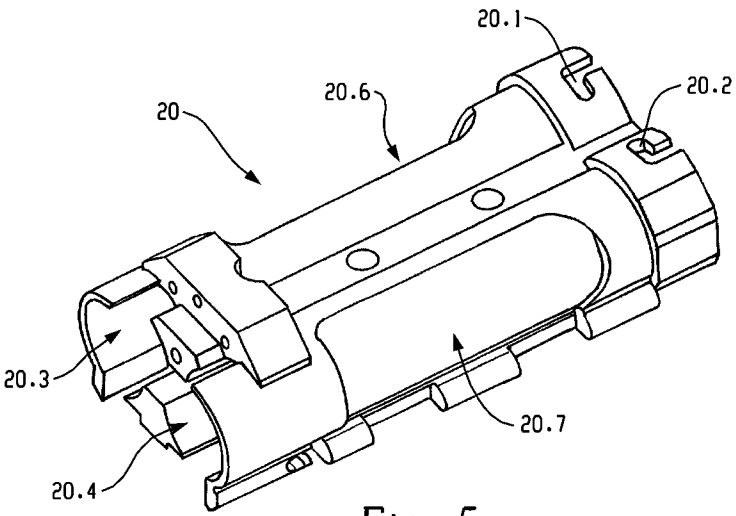
FIG. 5 is a perspective view of a monoblock member according to an embodiment of the present disclosure.

Further examination of the feed area 27 of shotgun 1 shows interrupter 62 mounted intermediate the left and right feed ports, 20.3, 20.4 (see FIGS. 3-5). At the stage depicted in the figure, cartridge 28 has just been fed into the feed area 27 from one of the feed tubes 40, 42 by cocking the shotgun 1, that is, racking the fore-end 32 toward the rear of the weapon. This process extracts any spent cartridges from the barrel 34 by the rearward travel of bolt head 52 in cooperation with ejector member 54 and ejects any spent cartridges from the feed area 27 through ejection port of upper receiver 14. During the initial racking operation, the bolt carrier 56 is directed toward the rear of the shotgun 1 which causes a series of other actions to occur.

Figure 7A:
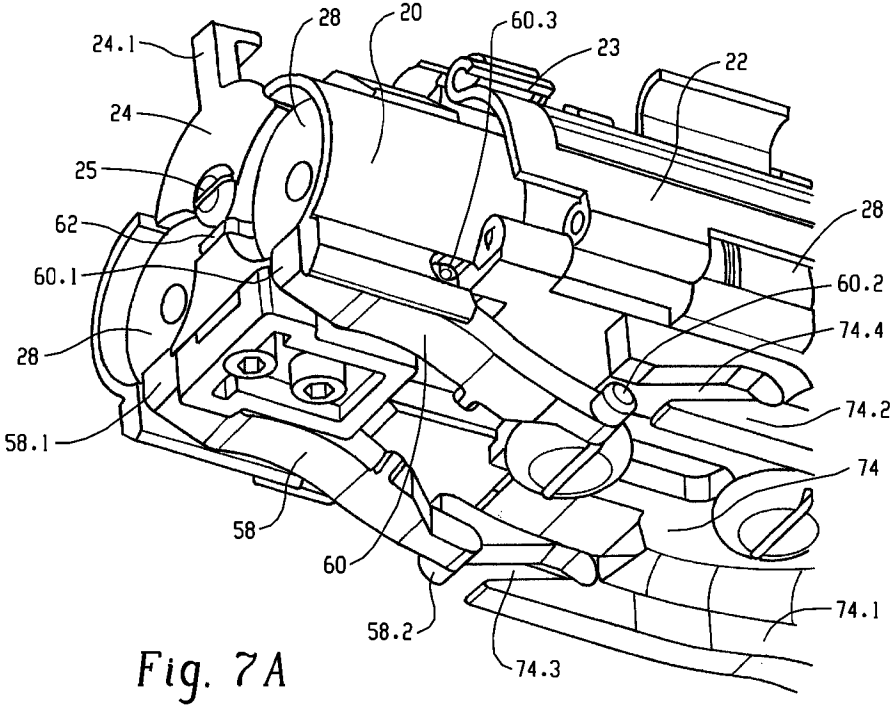
FIG. 7A is a partial bottom perspective view of the rear portion of the magazine assembly according to an embodiment of the present invention.

Looking additionally to FIG. 7A, cocking the shotgun 1 by racking the fore-arm 32 to the rear causes cartridge release plate 74 to move toward the rear of the weapon. In doing so, channels 74.2, 74.3 engage camming portions 58.2, 60.2 of gate members 58 and 60 thus causing the gate members to pivot about gate member pivot ear 58.3 (not shown) and 60.3. This, in turn causes the first blocking portions 58.1, 60.1 to drop out of the feed paths of both tubular members 40, 42 allowing a single cartridge 28 already in position in the "ready to feed" stage to be fed into the feed area 27. As seen in FIG. 7, the cartridge 28 in the right tubular feed port 20.4 of monoblock 20, is staged closest to the rear of the monoblock, held back only by the gate member blocking portion 60.1. As gate member pivots and first blocking portion 60.1 is lowered out of the end-most cartridge's feed path, a second blocking porting 60.3 is pivoted upwardly and impedes the successive cartridge 28 from simultaneously feeding along with the end-most cartridge. This prevents a double feed from the same tubular member 42 during the cocking operation.

Cartridges 28 being fed into the feed area 27 are centered on the centerline of the shotgun 1 by the funneled sides (not shown) within the stock 16. Downwardly-biased feed member 26 is triggered by a cartridge 28 being fed from the feed port 20.3, 20.4 of either of the tubular members 40, 42 and impinging upon a trigger plate portion 29 of a reciprocally pivotable tripper mechanism 31. Upon being triggered, feed member 26 quickly snaps downward, much like a spring-loaded mouse trap, centering cartridge 28 in its recessed "spoon" area and urging the cartridge to seat squarely within the parallel rails 56 of a bolt slide (not shown) located in the upper and lower receiver portions 12, 14 and beneath the hinged stock 16 of the firearm 1. This alignment of the cartridge 28 enables it to be properly seated within the chamber of the barrel 78 by the bolt head 54 when the fore-end 32 is slid back to its front position during the cocking operation.

Figure 7B:
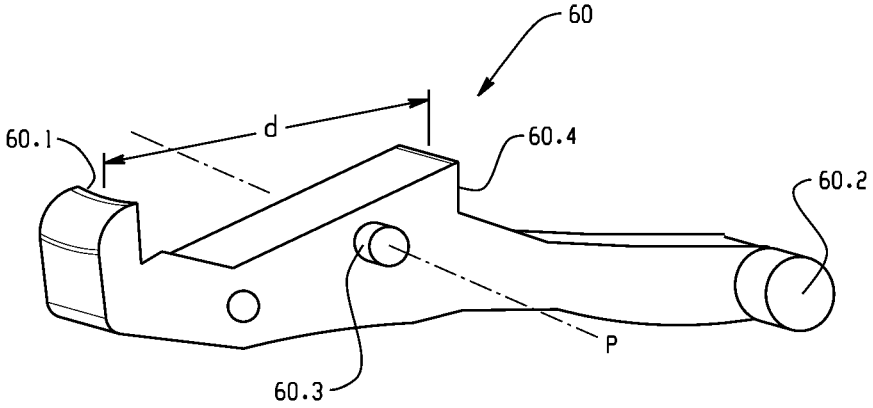
FIG. 7B is a perspective elevational view of one of the gate members corresponding to the like numbered element of FIG. 7A, according to an embodiment of the present invention.

In summary, referring to FIGS. 5, 7A and 7B, it will be appreciated that, under normal operating conditions, each cartridge 28 being fed from either feed port 20.3 or 20.4 of monoblock 20, as supplied from tubular members 40, 42, may pass through at least three discrete stages, namely: the first being the face of first blocking portion 60.4 during the cocking operation; secondly, impingement upon one of the shoulders 62.1, 62.2 of interrupter 62 projecting into one of the feed ports 20.3 and 20.4; and finally the face of either of second blocking portions 58.1 or 60.1, wherein the end-most cartridge is in the "next to feed" position.

Referring now to FIGS. 1-8, a summary of the operation follows. In preparation for loading the firearm 1, magazine flower spring 70 is compressed by either by sliding the magazine follower body 64, 66, of the tubular member to be loaded, forward using the respective magazine follower cocking handles 66.1 and 66.2, if provided, that each project through longitudinal slots 40.1, 42.1 in the top surface of tube members 40, 42 and cutaways in the tops of left and right side covers 38, 39. When either magazine follower 64, 66 is fully forward, the magazine tube spring 70 is in its compressed state. At this stage of loading, the selected magazine follower cocking handle 64.1, 66.1 is partially rotated outwardly from the centerline of the shotgun 1 into a locking slot 64.2 (not shown), 66.2, formed between the ends of left and right side covers 38, 39 and front magazine cap 44. Once rotated into the corresponding locking slot, 64.2, 66.2, magazine follower 64, 66 is securely held in place by the return pressure provided by the magazine follower spring 70, which is retained in its compressed state while cartridges 28 are loaded into successive magazine tubular members 40, 42 through their associated loading ports 20.6, 20.7.

In the embodiment that does not employ externally operable magazine followers extended through slots 40.1, 42.1 in magazine tubes 40, 42, the magazine springs 72 within magazine tubes are compressed by the operator of the weapon 1 as successive rounds are loaded through respective loading ports 20.6, 20.7.

Figure 8:
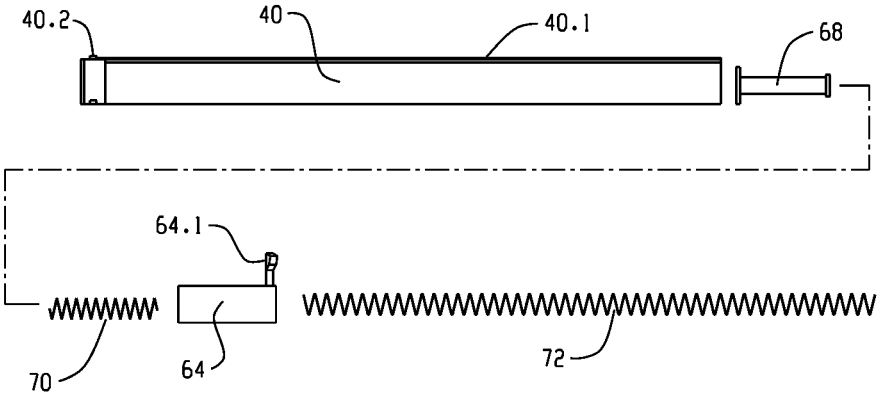
FIG. 8 is an exploded elevational view of a slotted tubular magazine member and its internal components according to an embodiment of the present invention.

The magazine follower 64, 66 may be constructed in multiple parts as depicted in the exploded view of FIG. 8 with the rear-most portion 68 constructed in such a way so as to allow it to compressingly nest within the cavity of magazine follower 64, 66 when the tubular magazines 40, 42 are loaded with cartridges 28. Ammunition, shown in the form of shotgun shell cartridges 28, is loaded into the tubular members 40, 42 via loading ports 20.6, 20.7 in the top sections of the monoblock 20. When the tubular members 40, 42 and monoblock tubes 20.3, 20.4 are fully loaded, the loading port doors 22 are closed, locked via spring locks 23 and then magazine follower cocking handles 64.1, 66.1, if provided. are rotated out of their respective locking slots 64.2 (not shown) and 66.2, if provided, thus allowing the magazine followers 64, 66 to slidingly engage left and right longitudinal magazine tube slots 40.1, 44.1 enabling magazine follower spring 70 to exert force upon the loaded cartridges 28, urging them rearward for feeding and ultimate delivery into the barrel chamber 78 of firearm 1.

At one of the stages, the cartridges 28 loaded in the tubular members 40, 42 are urged rearward by the magazine follower spring 70 to the shoulder 62.1 of the interrupter 62. Generally horizontal and planar interrupter 72 pivots on a vertically oriented pin (not shown) within a machined slot 20.5 of monoblock 20. This mounting arrangement enables interrupter 62 to passively reciprocate in a wig-wag fashion, alternately protruding into the interior of the neighboring feed port 20.3, 20.4 of monoblock 20 when the shouldered side 62.1 of the interrupter is confronted by the rear rim 28.1 of the cartridge 28 positioned in the "ready to feed" feed port 20.3, 20.4. In this manner the interrupter 62 is passively deflected into the neighboring feed port 20.3, 20.4, so that the forward edge of the interrupter projects into the feed path of an adjacent feed port thus inhibiting the "next to fire" cartridge 28 from advancing within its feed port. This prevents the cartridge 28 from moving into a "ready to feed position" until the adjacent, end-most cartridge has been chambered. With the cartridge 28 blocked forward of the blocking portion 58.1, 60.1 of the gate member 58, 60, the gate members are fully depressed by the cartridge gating release spring (not shown) thus lowering the camming member 58.2 (not shown), 60.2 of the gate member out of sliding engagement with the camming groove 74.4 of cartridge release plate 74. At this same time the end-most cartridge 28 in the adjacent feed port is in a "ready to feed" position which urges the camming member portion 58.2, 60.2 of the gate member 58, 60 upwardly to align with and engage the camming groove 74.4 of the cartridge release plate 74.

At this point the term "loading" will hereinafter refer to the process of feeding a cartridge 28 from one of the feed ports 20.3, 20.4 of the monoblock 20, centering the cartridge between the guide rails 56 with feed member 26, urging the cartridge into the chamber of the barrel 78 by confronting the rear of the cartridge with the face of bolt 52. At the beginning of the loading cycle the bolt 52 moves rearward on the bolt carriage (not shown). As the bolt's face passes the ejector port a portion of the bolt carriage (not shown) confronts the cartridge release plate 74 forcing it rearward. As it moves rearwardly, the camming groove 74.4 of cartridge release slide 74 engages the camming members 58.2, 60.2 of the left and right gate members 58, 60, only one of which is in physical contact with a cartridge 28 retaining it in the "ready to feed" position. The capture and actuation of the camming member 58.2, 60.2 by the camming grooves 74.3, 74.4 urges the front portions of the pivoting gate members 58, 60 upward, which in turn, lowers first blocking to portions 58.1, 60.1, at the rear of the gate members and thus releases the end-most cartridge 28 from the readied feed port 20.3, 20.4. As the first blocking portion 58.1, 60.1 lowers to release the cartridge 28 from the feed port 20.3, 20.4 of monoblock 20, the second blocking portion 58.4 (not shown), 60.4 of the gate members 58, 60 protrudes through slots (not shown) into the bottom of the monoblock thereby blocking the next cartridge in line and reducing the possibility of a double feed (two cartridges feeding simultaneously from the same feed port). Preferably, the distance between first 58.1, 60.1 and second 58.4, 60.4 blocking portions of gate members 58, 60 is less than the shortest available cartridge size. In terms of a shotgun, this distance "d" is preferably less than 1.5 inches to accommodate the shortest shell cartridge 28.

As the cartridge rim 28.1 passes the interrupter 62, the interrupter is released and urged to pivot from the pressure on the opposing shoulder 62.1 from the leading shell in the adjacent feed port 20.3, 20.4 as it is guided into the "ready to feed" position. Upon pivoting in the opposing direction, the interrupter 72 now blocks the leading cartridge 28 in the adjacent feed port, completing the cycle.

Returning the fore-end 32 to the front of the firearm 1 causes the cartridge to seat into the chamber of barrel 78. Once the cartridge is seated within the chamber of barrel 78, the bolt extractor 54 continues forward and extends beyond the rear rim 28.1 of the cartridge 28 thereby positioning itself in a gripping position for extracting the cartridge from the chamber upon the succeeding the cocking, cartridge ejection operation.

A pivotable selector switch 24, pivoting about selector switch screw 25 and having a handle portion 24.1 may be provided at the rear of the magazine assembly 10 and for selecting between differing cartridges 28 that may be loaded in the two tubular members 40, 42. For the sake of illustration, and not for purposes of limitation, one tubular member, as at 40, could be loaded with slug-type ammunition and the second tubular member, as at 42, with shot. Likewise, one tubular member 40, 42 may be loaded with 3" shotgun cartridges and the second tubular member 42 may be loaded with 1½" or 2¾" shells. Likewise, less-than-lethal cartridges 28 may be utilized in one or both of the tubular members 40, 42, depending upon the intended purpose of the firearm 1. When loaded with 2¾" cartridges, the UTS-15 firearm 1 has a capacity of carrying a total of 15 shotgun cartridges between the magazine assembly 10 and the barrel chamber 78. If loaded with shorter cartridges 28, such as the 1.5" long shotgun cartridge, the capacity of to the firearm increases to between 20 and 21 cartridges without further modification to the weapon or magazine. If the magazine selector switch 24 is utilized to select a particular tubular member 40, 42 from which to feed cartridges 28, the adjacent feed port is blocked by the body portion of the selector switch and the interrupter 72 no longer functions. In this case the first blocking portion 58.4, 60.4 of the respective gate member 58, 60 of the selected feed port 20.3, 20.4 controls the feeding of cartridges exclusively. A selectable safety switch 80 is provided to place a loaded firearm 1 into a non-operational state when rotated into a "safe position", thus inhibiting the unintended firing of the firearm.

From the above description of the invention, those skilled in the art will perceive improvements, changes, and modifications in the invention. Such improvements, changes, and modifications within the skill of the art are intended to be covered within the scope of the following claims.

I claim:

1. A magazine assembly for firearm cartridges, comprising:

a plurality of side by side tubular members each capable of receiving a plurality of cartridges, the tubular members being non-displaceably fixed with respect to a firearm upon which the magazine assembly is mounted;

a generally hollow monoblock member, having a plurality of side-by-side, generally tubular portions extending therethrough and being axially coupled to an end of each of the tubular members, the monoblock providing a cartridge loading port and a cartridge feed port for each of the coupled tubular members;

a plurality of independent gate members pivotally mounted at an end region of the monoblock and each having a biased first blocking member near an opening of a corresponding one of the cartridge feed ports and into the feed path of an end cartridge, the gate members cooperable with a cocking portion of the firearm to displace one of the first blocking members from the feed path during actuation of the cocking portion; and at least one cartridge interrupter pivotally mounted to the monoblock and located intermediate the cartridge feed ports, the cartridge interrupter having a pair of shouldered opposing sides and being pivotable to cause each shoulder to project into a corresponding feed port upon impingement of the opposing shoulder by a cartridge in one of the opposing tubular members for preventing the simultaneous feeding of cartridges from opposing feed ports during actuation of the cocking portion.

2. The magazine assembly as claimed in claim 1, which includes biasing means for urging the cartridges from the tubular members towards their corresponding feed ports of the monoblock, the biasing means being in the form of a cartridge follower housed in each of the tubular members and urged by a coil spring towards the feed ports of the monoblock.

3. The magazine assembly as claimed in claim 2, wherein the tubular members each have a longitudinal slot through which a handle of a cartridge follower projects.

4. The magazine assembly as claimed in claim 3, wherein the handle of the cartridge follower is actuable to fully compress the coil spring between a body portion of the cartridge follower and a front magazine cap.

5. The magazine assembly as claimed in claim 4, wherein the handle of the cartridge follower may be rotated into a locked position to retain the coil spring in a compressed state to relieve substantially all pressure from the coil spring during a loading of the firearm.

6. The magazine assembly as claimed in claim 1, wherein at least one of the pivoting gate members further comprises a seconding blocking member that projects into the tubular member and into the feed path of a second to the end cartridge during the cocking operation to prevent the ejection of more than one cartridge from a single tubular member when the first blocking member is displaced out of the feed path of the end cartridge.

7. The magazine assembly as claimed in claim 6, wherein the distance between first and second blocking portions is less than or equal to 1.5".

8. The magazine assembly as claimed in claim 1, further comprising a selector switch operable between a first position that permits cartridges to be fed alternately from each of the tubular members, to at least a second position wherein a portion of the selector switch projects into the feed path of cartridges in a selected tubular member thereby preventing the feeding of all cartridges from that tubular member for so long as the selector switch remains in that at least second position.

9. The magazine assembly as claimed in claim 1, wherein the firearm cartridges are shotgun cartridges.

10. The magazine assembly as claimed in claim 1 further including indicia means visible on a top side of the firearm for providing an indication of a number of cartridges remaining in either or both of the tube members.

11. The magazine assembly as claimed in claim 1 wherein each of said plurality of side by side tubular members is at least partially transparent to display the number of cartridges remaining in each respective tube.

12. The magazine assembly as claimed in claim 11 wherein each of said plurality of side by side tubular members are unslotted.

13. A shotgun having a magazine assembly comprising, a dual tube magazine assembly comprising a plurality of side by side tubular members each capable of receiving and storing a plurality of cartridges, the tubular members being non-displaceably fixed with respect to the shotgun;

a generally hollow monoblock member, having a plurality of side-by-side, generally tubular portions extending therethrough and being axially coupled to an end of each of the tubular members, the monoblock providing a cartridge loading port and a cartridge feed port for each of the coupled tubular members;

a plurality of independent gate members pivotally mounted at an end region of the monoblock and each having a biased first blocking member near an opening of a corresponding one of the cartridge feed ports and pivotable into the feed path of an end cartridge, the gate members co-operable with a cocking portion of the shotgun to displace one of the first blocking members from the feed path during actuation of the cocking portion; and at least one cartridge interrupter pivotally mounted to the monoblock and located intermediate the feed ports, the cartridge interrupter having a pair of opposing shouldered sides and being actuable to cause each shoulder to project into a corresponding feed port upon impingement of the opposing shoulder by a cartridge in the opposing feed port for preventing the simultaneous feeding of cartridges from opposing feed ports during actuation of the cocking portion;

guide rails within a receiver portion of the shotgun linearly aligned with the chamber portion of a gun barrel for receiving cartridges fed from the magazine assembly prior to being inserted into a chambered barrel of the firearm; and a downwardly biased feed member centrally mounted rearward of the feed ports of the magazine assembly and movable between a upward, inoperative and downward, operative positions for urging linear alignment of the fed cartridges within the guide rails and axial alignment of the cartridges with the chamber of the barrel.

14. The shotgun as claimed in claim 13, wherein the feed member is maintained in its inoperative position by a reciprocally pivotable tripper mechanism located in the path of and triggered into its operative position by a cartridge being fed from the magazine assembly under pressure of a coil spring.

15. The shotgun as claimed in claim 13, wherein the feed member is re-biased in its inoperative, upward position following a complete cycling of the cocking mechanism.

16. The shotgun as claimed in claim 13 wherein each of said plurality of side by side tubular members of the dual tube magazine assembly is at least partially transparent to display the number of cartridges remaining in each respective tube.

17. The shotgun as claimed in claim 13 having a magazine assembly wherein each of said plurality of side by side tubular members of the magazine assembly are unslotted.

* * * * *